United States Patent [19]

Bergeson et al.

[11] Patent Number: 4,762,433

[45] Date of Patent: Aug. 9, 1988

[54] FLUID APPLICATOR FOR SHOES AND THE LIKE

[75] Inventors: Larry W. Bergeson, Racine, Wis.; Vincent J. Lasorso, Jr., Columbus, Ind.; Russell H. Petersen, Sturtevant; Ronald G. Ruffalo, Racine, both of Wis.

[73] Assignee: S. C. Johnson & Son, Inc., Racine, Wis.

[21] Appl. No.: 68,856

[22] Filed: Jul. 2, 1987

[51] Int. Cl.[4] ..... A47L 23/05; A47L 13/16

[52] U.S. Cl. ..... 401/206; 401/186; 401/264; 401/207

[58] Field of Search ..... 401/205, 206, 264, 186, 401/207

[56] References Cited

U.S. PATENT DOCUMENTS

| | | | |
|---|---|---|---|
| 190,644 | 5/1877 | Swift . | |
| 264,811 | 9/1882 | Wise . | |
| 395,905 | 1/1889 | Jensen . | |
| 404,795 | 6/1889 | McFarland . | |
| 524,158 | 8/1894 | Berk . | |
| 632,189 | 8/1899 | Knott . | |
| 1,221,066 | 4/1917 | Lynch . | |
| 1,243,967 | 10/1917 | Nielsen . | |
| 1,388,001 | 8/1921 | Pupilla . | |
| 2,180,506 | 11/1939 | Burbig . | |
| 2,197,052 | 4/1940 | Lowen . | |
| 2,209,544 | 7/1940 | Seeberger . | |
| 2,210,206 | 8/1940 | Fisher . | |
| 2,234,558 | 3/1941 | Huston . | |
| 2,265,603 | 12/1941 | Kingman . | |
| 2,282,406 | 5/1942 | Hollenbeck . | |
| 2,314,383 | 3/1943 | Berners | 401/186 |
| 2,409,933 | 10/1946 | Fleisher et al. . | |
| 2,622,257 | 12/1952 | Lemonds et al. . | |
| 2,820,234 | 1/1958 | Rigney . | |
| 2,939,615 | 6/1960 | Lerner . | |
| 2,962,743 | 12/1960 | Henriksson . | |
| 2,974,350 | 3/1961 | Schwartzman . | |
| 2,975,465 | 3/1961 | Lerner et al. . | |
| 3,006,024 | 10/1961 | Nelson et al. . | |
| 3,010,140 | 11/1961 | Thomas . | |
| 3,023,448 | 3/1962 | Fagan . | |
| 3,072,953 | 1/1963 | Bunke . | |
| 3,147,512 | 9/1964 | Gleason . | |
| 3,148,401 | 9/1964 | Gilchrist et al. . | |
| 3,192,553 | 7/1965 | Schwartzman . | |

(List continued on next page.)

FOREIGN PATENT DOCUMENTS

| | | | |
|---|---|---|---|
| 1503859 | 5/1969 | Fed. Rep. of Germany | 401/205 |
| 1375754 | 9/1964 | France | 401/264 |

*Primary Examiner*—Steven A. Bratlie

[57] ABSTRACT

A novel fluid applicator, together with a combination comprising the fluid applicator and a fluid container, are disclosed. The fluid applicator comprises a container cap having an external sidewall defining an exterior cavity. The fluid applicator further comprises an insert removably disposable into the cap cavity and engageable with the cap sidewall. The cap cavity insert comprises a fluid-distributing substance such as a foam pad or dauber. The cap has a resiliently-deformable domed surface, surrounded by the sidewall. A portion of the domed surface extends outwardly from the cap cavity. The domed surface defines at least two spaced-apart apertures or slits, at least one of which provides the domed surface with a valve means that opens in response to deformation of the domed surface, to allow fluid to flow by gravity through the one aperture or slit and to effect fluid communication from the fluid container to the fluid-distributing substance when a portion of the domed surface in the vicinity of such aperture or slit is subjected to a predetermined, dome-deforming force. Upon removal of the predetermined force, the valve means closes automatically in a substantially fluid-tight manner. At least a portion of the cap cavity insert is movable relative to the domed surface, for removably applying the predetermined force to the domed surface for opening and closing the valve means. The domed surface, moreover, is so configured as to enable fluid to flow by gravity generally away from each of the apertures or slits when the container is disposed in an upstanding position.

18 Claims, 3 Drawing Sheets

U.S. PATENT DOCUMENTS 3,220,044 11/1965 Smalley .
3,256,551 6/1966 Schwartzman .
3,276,067 10/1966 Boyle et al. .
3,281,887 11/1966 Raffe .
3,337,900 8/1967 Schwartzman .
3,355,240 11/1967 Schwartzman .
3,410,645 11/1968 Schwartzman .
3,468,611 9/1969 Ward .
3,481,678 12/1969 Schwartzman .
3,601,287 8/1971 Schwartzman .
3,645,821 2/1972 Baumann et al. .
3,653,779 4/1972 Schwartzman .
3,663,113 5/1972 Frain et al. .
3,698,824 10/1972 Lorio .
3,805,990 4/1974 Palaudarias .
4,077,725 3/1978 Slautterback .
4,089,609 5/1978 Gring et al. .
4,133,614 1/1979 Baginski et al. .
4,183,328 1/1980 Lawrence .
4,201,491 5/1980 Kohler .
4,555,194 11/1985 Hammond .

FLUID APPLICATOR FOR SHOES AND THE LIKE

TECHNICAL FIELD OF THE INVENTION

The present invention is directed to a novel fluid applicator for applying a suitable fluid onto shoes and the like. The novel fluid applicator is preferably used to apply shoe polish onto a shoe. The present invention is also directed to a combination comprising the novel fluid applicator together with a fluid container.

BACKGROUND OF THE INVENTION

Although the area of fluid applicator art for shoes is crowded, there is room for improvement of fluid applicators of this type. For example, while a number of conventional fluid applicators comprise a plurality of mechanical elements and/or components that are designed to cooperatively function in a predetermined manner, many fluid applicators of this type, as a practical matter, often do not function entirely as desired. That is, a fluid passageway or an orifice may plug or leak; a valve or a biasing element may jam; or mechanical elements (or components)—although designed to sealingly engage together—may not seat properly. Any one of the several aforementioned occurrences may result in the conventional fluid applicator functioning in a less-than-desired manner.

Occasionally, failure of only one of the often several mechanical elements and/or components may even render the conventional fluid applicator totally useless with respect to its intended purpose. For example, undesired fluid leakage can result when a single orifice, or a single valve, fails to close or seat properly. When the fluid is black shoe polish, such fluid leakage is, of course, generally totally unacceptable.

The present fluid applicator is configured not only to virtually eliminate pluggage of its discharge aperture (or discharge orifice) but also to keep its fluid passageway and associated valve means unclogged as well. To achieve this end, the present fluid applicator includes a valve means which seals automatically when not in use (the details of which will be further discussed hereinbelow). Still further, the present fluid applicator is relatively simple in construction, an important operational consideration.

SUMMARY OF THE INVENTION

The present invention is directed not only to a novel fluid applicator but also to a combination comprising the present fluid applicator together with a generally elongated fluid container. The present fluid applicator is preferably used to apply shoe polish onto a shoe.

The elongated fluid container includes an integral base and is generally configured to contain the desired fluid in an upstanding manner when positioned on its base. The fluid container has a mouth or opening—at that end portion which is opposite the base—and is able to be manipulated from the upstanding position to a so-called "working" (i.e., "inverted") position (whereby the fluid is permitted to flow by gravity through the fluid container opening). The container can, of course, be designed to be squeezable when inverted, if desired.

The novel fluid applicator comprises an applicator cap having an exterior sidewall defining an exterior, applicator cap cavity. The applicator further comprises an insert removably yet snugly receivable into the cap cavity and engageable with the cap sidewall.

The insert comprises a fluid-distributing material, the composition of which will be discussed in detail below.

The cap is removably engageable with the fluid container mouth or opening so as to provide the fluid container with a substantially fluid-tight seal along the junction where the applicator cap comes in contact with the fluid container mouth or opening.

The applicator cap has a resiliently-deformable domed surface surrounded by the applicator cap sidewall. A portion of the applicator cap domed surface extends outwardly from the applicator cap cavity.

The domed surface defines at least two, and preferably three, spaced-apart apertures. At least one of the domed surface apertures provides the resiliently-deformable domed surface with a valve means. Such valve means opens in response to deformation of the domed surface, to allow fluid to flow by gravity through the one aperture thereby effecting fluid communication between the fluid container and the fluid-distributing substance when the fluid container is disposed in its inverted position and a portion of the domed surface in the vicinity of such aperture is subjected to a predetermined, aperture-opening force. Upon removal of the predetermined force from the domed surface—and principally because of the resilient characteristic of the domed surface—the valve means closes automatically in a substantially fluid-tight manner.

At least a portion of the fluid applicator insert is movable relative to the applicator cap domed surface so as to enable the predetermined force to be removably applied to the domed surface, for opening and closing the domed surface valve means as desired. The domed surface, moreover, is itself so configured as to enable fluid to flow by gravity generally away from each of the apertures when the domed surface is disposed generally upwardly (i.e., when the container is positioned on its base, in its upstanding position).

BRIEF DESCRIPTION OF THE DRAWINGS

In the drawings.

Throughout the drawings, like reference numerals are used to refer to like parts.

DETAILED DESCRIPTION OF THE ILLUSTRATED EMBODIMENTS

Figure 1:
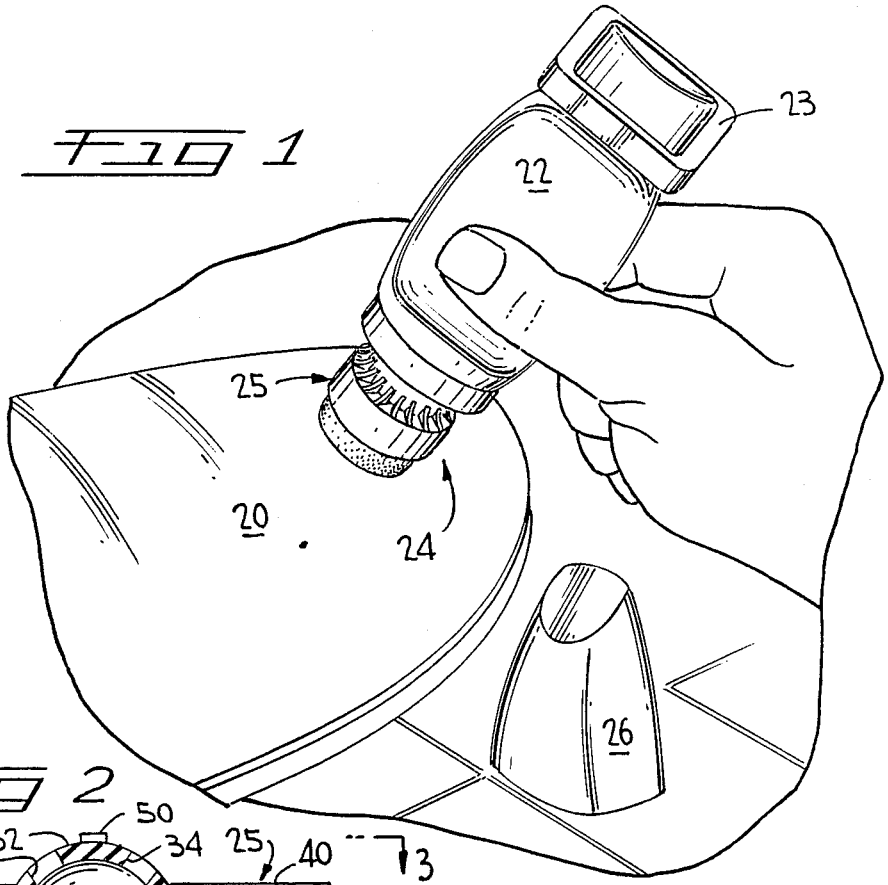
FIG. 1 is a perspective view of one preferred embodiment of the applicator-and-container combination of the present invention.
Figure 4:
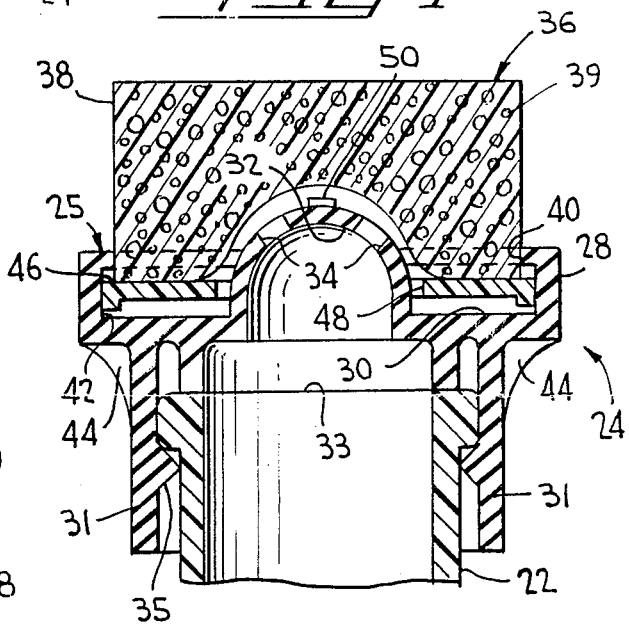
FIG. 4 is a view similar to that of FIG. 2, showing one embodiment of the applicator cap insert of the present invention.
Figure 6:
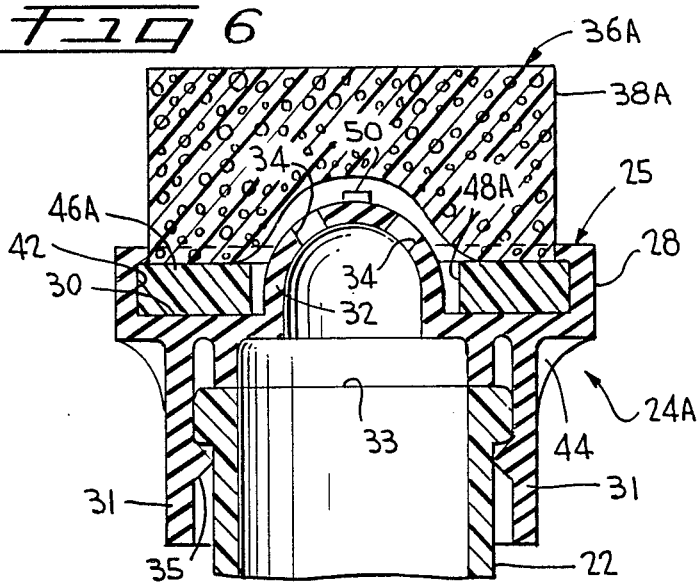
FIG. 6 is a side view, in section, showing another embodiment of the applicator cap insert of the present invention.
Figure 7:
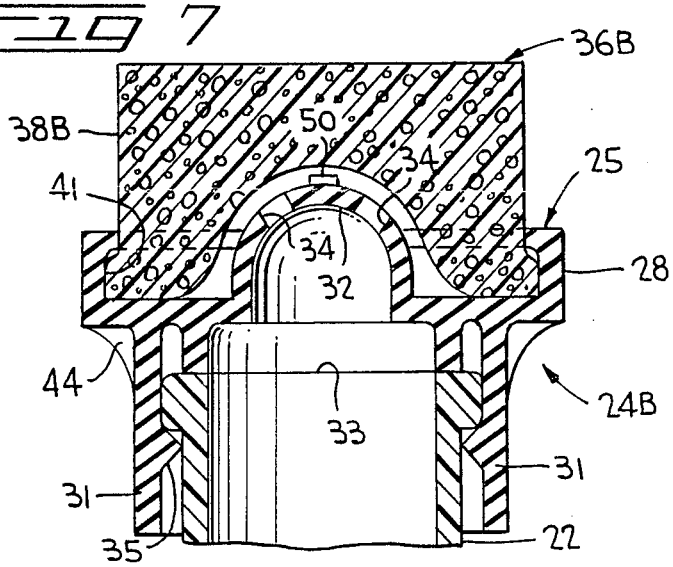
FIG. 7 is also a side view, in section, showing of yet another embodiment of the applicator cap insert of the present invention.

While the present invention is susceptible to embodiment in various forms, there are shown in the accompanying drawings, and hereinafter described in detail, a number of preferred embodiments illustrating the principles of the present invention. For example, while FIGS. 4, 6 and 7 illustrate three preferred embodiments of the novel fluid applicator, FIG. 1 illustrates the novel applicator-and-container combination in one preferred use, namely, for manually applying shoe polish onto a shoe. The present disclosure, therefore, is to be considered as an exemplification of the present invention without limitation to the specific embodiments illustrated.

As FIG. 1 illustrates, the present invention is preferably hand held and is configured to contain a suitable fluid, such as shoe polish, for application onto a shoe 20. Alternatively, other suitable shoe-application fluids, in accordance with the principles of the present invention, include water-repellent fluids for shoes, and the like. Still further, the present invention—as will be appreciated by those skilled in the art—can be used to apply a suitable fluid onto a variety of surfaces, so as to provide a corresponding variety of surface-treatment applications.

Thus, in accordance with one aspect of the present invention, a bottle or container 22 is so configured as to contain such a fluid; and the container 22 has an opening or mouth 33 (FIG. 2) through which the fluid is able to flow by gravity when the container 22 is disposed in the inverted position, as is shown in FIG. 1. The container 22 is further generally configured to include an integral base 23 (FIG. 1), to enable the container 22 to be disposed in an upstanding position (such position is not shown) when desired.

Turning now briefly to FIGS. 2–5, the novel fluid applicator of the present invention will be discussed.

The illustrated fluid applicator 24 is removably yet snugly engageable with the opening or mouth 33 of container 22, for providing the fluid container 22 with a substantially fluid-tight seal around the opening 33 thereof.

A substantially hollow overcap 26 (FIG. 1) is preferably configured so as to receive the fluid applicator 24, and to removably engage with the container 22, so that the container 22 can conveniently be stored, for example, in a glove compartment, a purse, or the like, until use of the fluid applicator 24 is desired.

The fluid applicator 24—preferably made of a suitable, substantially resilient material such as plasticized polyvinyl chloride (PVC), a synthetic rubber, and the like,—comprises a container cap 25 (FIGS. 2–7) having an exterior, cap sidewall 28 defining an external, cap cavity 30. (Another suitable material for the fluid applicator 24 is a thermoplastic rubber currently commercially available by Monsanto Co. and known in the art by its brand name "Santoprene".) The container cap 25 is removably—yet snugly—engageable with the fluid container 22, for providing the fluid container 22 with a substantially fluid-tight seal along the mouth or opening 33 thereof.

Preferably, the container cap 25 includes a substantially hollow, integral annular collar 31 having a cross-sectional area—dimensioned relative to the cross-sectional area of the fluid-container opening 33, and otherwise configured—so as to provide the fluid container 22 with the substantially fluid-tight seal mentioned above. In particular, as is shown in FIGS. 2 and 4–7, the resilient collar 31 can be suitably internally configured to include a resilient annular abutment 35, so that the fluid container 22 and the fluid applicator 24 are not only removably engageable (as mentioned above) but also capable of providing the above-mentioned substantially fluid-tight seal along the entire circumference of the container opening or mouth 33.

Figure 2:
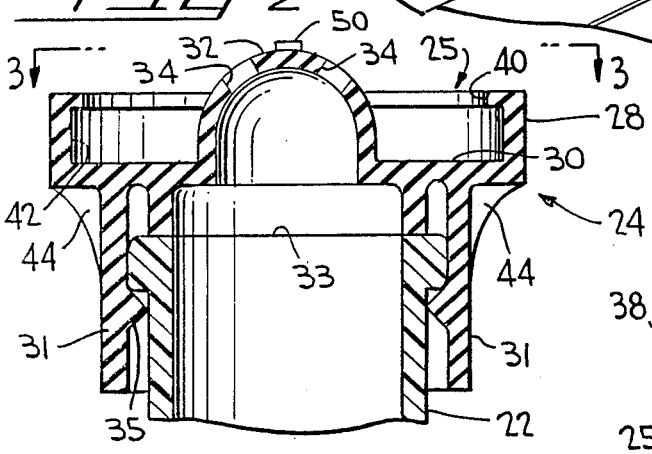
FIG. 2 is a partially-fragmented side view, in section and on an enlarged scale relative to FIG. 1, illustrating some of the structural and/or mechanical elements or components of the fluid applicator and fluid container of the applicator-and-container combination of the present invention.
Figure 3:
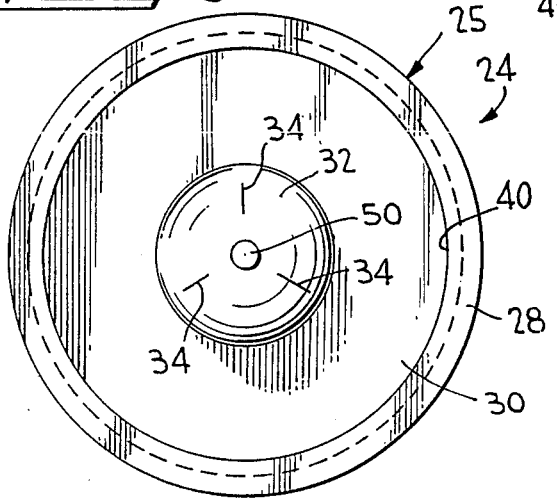
FIG. 3 is a top, plan view taken substantially from the plane 3—3 in FIG. 2.

The container cap 25 has a resiliently-deformable domed surface 32, that is preferably substantially hemispherical in shape (FIGS. 2 and 3) and surrounded by the cap sidewall 28. A portion of the domed surface 32 extends outwardly from the cap cavity 30 (FIG. 2). The domed surface 32 defines at least two spaced-apart orifices or apertures 34. Preferably, the domed surface 32 defines three spaced-apart apertures 34 (FIG. 3), each such aperture 34 being characterized as a radially disposed slit, any one slit being spaced substantially equally from its two nearest slit neighbors (i.e., above 120 degrees).

Referring in particular to the domed surface 32, the preferred inside radius of the hemisphere—for applying shoe polish—is about 0.137 inches. Selecting a suitable hemisphere radius is, of course, a matter of design choice, which is a matter that is well known to those skilled in the art.

The fluid applicator 24 further comprises a cap insert 36 (FIG. 4) removably yet snugly receivable into the cap cavity 30 and engageable with the cap sidewall 28. The insert 36 comprises a fluid-distributing substance or material such as the illustrated absorbent, foraminous, resilient, sponge-like or foam applicator pad or dauber 38. Preferably the fluid-distributing material is an absorbent foam—such as reticulated polyurethane—having about 30 to about 40 pores per linear inch.

The domed surface 32 of the container cap 25 further preferably includes an exterior, integral nipple or protuberance 50 (FIGS. 2 and 4), extending outwardly from the cap cavity 30 and disposed toward the foam pad or dauber 38.

The foam pad or dauber 38 is characterized as consisting essentially of interconnected, relatively small-diameter passageways 39 (FIG. 4). The foam pad or dauber 38 is, moreover, preferably configured so that the desired fluid—such as shoe polish—is applied substantially evenly onto the desired substrate (e.g., a shoe). The foam pad or dauber 38 is further preferably configured so that undesirable fluid-flow problems (such as fluid "running" and fluid "dripping" problems), typically met in many conventional fluid-application situations, are substantially eliminated. To meet these ends, the illustrated foam pad or dauber 38 preferably has a thickness of about ½ to about 1 and ¼ inches, such being a matter of design choice.

Figure 5:
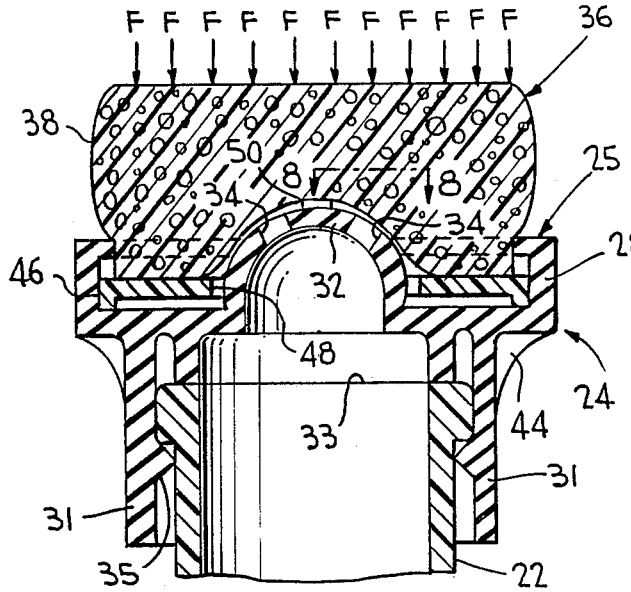
FIG. 5 is a side view, in section, showing the result of applying a substantially evenly-distributed force to the top of the applicator cap insert shown in FIG. 4.

At least one of the apertures or slits 34 provides the domed surface 32 with a valve means which opens in response to deformation of the domed surface 32 to allow fluid to flow by gravity through the one slit thereby effecting fluid communication from the fluid container 22 to the foam pad or dauber 38 when the fluid container 22 is disposed in the inverted position (FIG. 1) and a portion of the domed surface 32 in the vicinity of the such aperture or slit 34 is subjected to a predetermined force F. As is shown in FIG. 5, the predetermined force F is preferably substantially evenly distributed over the top surface of the foam pad or dauber 38.

At least a portion of the cap cavity insert 36 is movable relative to the domed surface 32 for removably applying the predetermined force F to the domed surface 32 for opening and closing the valve means. The valve means, moveover—because of the resiliency of the cap 25 in general and the domed surface 32 in particular—closes automatically in a substantially fluid-tight manner upon removal from the domed surface 32 of the predetermined force F.

As those skilled in the art can appreciate, the slits may not close satisfactorily if the domed surface 32 is too thin, whereas the slits may not open satisfactorily if the domed surface is too thick. For the present invention, the wall thickness of the domed surface 32 is preferably about 2.997 to about 5.842 millimeters, which, of course, is a matter of design choice depending, for example, upon the type of resilient material chosen for the domed surface, the relative position and location of the slits, the individual slit length, etc. Accordingly, the preferred slit length is about 2.381 to about 3.969 millimeters; and the preferred slit position is centered (FIG. 3) and located about 0.114 inches above the base of the cap cavity 30. (Location above the cap cavity is a matter of design choice which depends—to a large extent, of course—upon the radius of the domed surface hemisphere and the wall thickness of the domed surface 32.)

The domed surface 32 is so configured as to enable fluid to flow by gravity generally away from each of the aperatures or slits 34 when the fluid container 22 is disposed in the above-mentioned upstanding position.

Preferably, the cap sidewall 28 includes a radially-inwardly disposed, integral flange 40 (FIGS. 2–4) for removably—yet snugly—retaining the cap cavity insert 36 in the cap cavity 30.

In particular, while FIGS. 4 and 5 illustrate how one embodiment of the cap cavity insert 36 is removably—yet snugly — retained in the cap cavity 30, FIGS. 6 and 7 illustrate how two other embodiments of the cap cavity insert 36A and 36B are, respectively, removably retained in the cap cavity 30 as well.

Preferably, the cap sidewall 28 defines an inner circumferential slot 42 (FIGS. 4 and 6) of radial and longitudinal dimension sufficient to removably receive the insert 36, 36A or 36B (FIGS. 4, 6 and 7, respectively) and to allow a portion of the cap cavity insert to be moved relative to the domed surface 32 (FIG. 5) to open (FIG. 8) and close (FIG. 4) the valve means automatically, as desired.

Further, the cross-sectional area of a portion of the insert 36, 36A or 36B is preferably so dimensioned relative to the cross-sectional area of the cap sidewall 28 and the flange 40 as to enable the cap cavity insert to be removably yet snugly received into the cap cavity 30, engageable with the cap 25 along the cap sidewall 28 thereof, and retained in the cap cavity 30 by the flange 40 (FIG. 4).

To provide the cap flange 40 with rigidity, the container cap 25 further preferably includes a plurality of peripherally spaced-apart exterior, integral ribs 44. Each such rib 44 is unitary or "integral" not only with the cap sidewall 28 but also with an exterior surface portion of the container cap 25, to provide the cap sidewall 28 with both radial as well as longitudinal support, for opposing any substantial sidewall deformation when the cap cavity insert 36, 36A or 36B is disposed in the cap cavity 30 and either the cap cavity insert or the cap sidewall 28 is moved relative to the other.

In the embodiments of the novel fluid applicator 24 and 24A that are shown in FIGS. 4 and 4, each of the inserts 36 and 36A further preferably comprises a respective ring 46 and 46A to which the foam pad or dauber 38 and 38A is preferably adhesively bonded, utilizing a suitable adhesive.

The illustrated ring 46 and 46A is preferably made of (or formed from) a substantially rigid material such as polystyrene, unplasticized PVC, and the like. As mentioned above, the entire container cap 25 is made from a resilient material; and it can be appreciated that the ring is preferably dimensioned relative to the cap cavity 30 so that the ring 46 and 46A is removably snap-engageable with the cap cavity 30. That is, the resilient nature of the container cap 25 is such as to enable the cap flange 40 to flex radially outwardly to receive the ring into—and, at some other time, able to similarly flex radially outwardly to allow the ring to be removed from—the cap cavity 30.

Relative to ring 46 (FIG. 4), the inner, circumferential slot 42 defined by cap sidewall 28 is of radial and longitudinal dimension sufficient to removably receive the ring 46 and to allow the ring 46 to be moved—to a minor degree—relative to the cap sidewall 28. While in other applications (FIG. 6) it is desirable that there be no longitudinal movement of the ring 46A relative to the cap 28. In either arrangement (i.e., FIGS. 4 or 6), the ring 46 and 46A is used to retain the foam pad or dauber 38 in the cap cavity 30.

In either embodiment, the ring 46 or 46A preferably defines a hole 48 or 48A that substantially surrounds the domed surface 32 of the container cap 25.

That is, the cross-sectional area of the ring hole 48 or 48A is preferably so dimensioned relative to the cross-sectional area of the domed surface 32 as to allow a major portion of the domed surface 32 to be disposed through the ring hole 48 or 48A and brought into biasing engagement with the foam pad or dauber 38 for opening the valve means in the manner described above.

Figure 8:
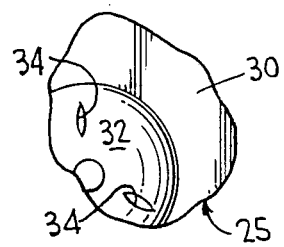
FIG. 8 is a fragmented, top, plan view taken substantially from the plane 8—8 in FIG. 5 (with the insert having been removed for purposes of clarity)

In preferred operation, a user presses the foam or dauber portion of the cap cavity insert against a shoe surface. A suitably deforming force, applied to the foam or dauber portion of the insert, causes the cap cavity insert to deform the domed surface 32 (FIG. 5). Such deformation, in turn, causes at least one of the apertures or slits 34 to open (FIG. 8). With the fluid container 22 in the inverted position (FIG. 1), fluid then flows by gravity onto and through the foam or dauber 38, and thereafter onto the shoe 20.

Alternatively, as is shown in FIG. 7, the cap cavity insert 36B need not include a ring at all. Rather, the foam pad or dauber 38B can be so formed as to have an integral, radially-outwardly disposed lip 41 which snugly fits within the inner circumferential slot defined by cap sidewall 28.

Figure 9:
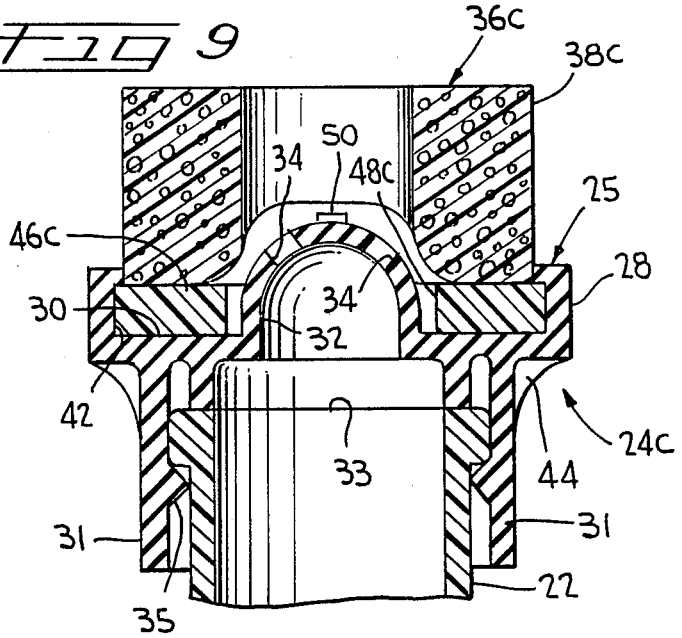
FIG. 9 is a side view, in section, showing still another embodiment of the applicator cap insert of the present invention.

Still further, as shown in FIG. 9, the foam pad or dauber 38C can be annular in shape and otherwise so configured as to allow the cap nipple 50 to be disposed through the foam pad or dauber 38C for direct contact with a shoe 20 (FIG. 1), if desired.

What has been illustrated and described herein is a novel fluid applicator and a combination comprising the fluid applicator together with a fluid container (that is removably engageable with the fluid applicator). While the principles of the present invention have been illustrated and described with reference to several preferred embodiments, the invention is not limited thereto. On the contrary, alternatives, changes or modifications will become apparent to those skilled in the art upon reading the foregoing description. Accordingly, such alternatives, changes and modifications are to be considered as forming a part of the invention insofar as they fall within the spirit and scope of the appended claims.

We claim:

1. A fluid applicator comprising:

a cap having a sidewall defining a cavity, the cap further having a resiliently-deformable domed surface surrounded by the sidewall, a portion of the domed surface extending outwardly from the cap cavity, the domed surface defining at least two spaced-apart apertures; and an insert removably disposable into the cap cavity and engageable with the cap sidewall, the insert comprising a fluid-distributing substance;

at least one of the two spaced-apart apertures providing the domed surface with a valve means (1) which opens in response to deformation of the domed surface to allow fluid to flow by gravity through the one aperture when a portion of the domed surface in the vicinity of such aperture is subjected to a predetermined dome-deforming force and such aperture is disposed generally downwardly and (2) which closes automatically in a substantially fluid-tight manner upon removal of the predetermined force from the domed surface, the domed surface being so configured as to enable fluid to flow by gravity generally away from each of the apertures when the domed surface is disposed generally upwardly;

at least a portion of the insert being movable relative to the domed surface for removably applying the predetermined force to the domed surface, for opening and closing the valve means.

2. The fluid applicator in accordance with claim 1 wherein the sidewall includes a radially-inwardly disposed, integral flange for removably retaining the insert in the cap cavity.

3. The fluid applicator in accordance with claim 1 wherein the fluid-distributing substance is reticulated polyurethane.

4. The fluid applicator in accordance with claim 1 wherein the domed surface defines three spaced-apart apertures, each such aperture being characterized as a radially disposed slit, any one slit being spaced substantially equally from its two nearest slit neighbors.

5. The fluid applicator in accordance with claim 1 wherein the cap is of a substantially resilient material, wherein the insert further comprises a ring to which the fluid-distributing substance is adhesively bonded, wherein the ring is of a substantially rigid material, wherein the resilient cap sidewall defines an inner circumferential slot of radial and longitudinal dimension sufficient to receive the ring and to allow the ring to be moved relative to the cap sidewall for opening and closing the valve means, and wherein the ring cross-sectional area is so dimensioned relative to the cross-sectional area of the resilient cap sidewall as to enable the ring not only to be removably disposable into the cap cavity but also engageable with the cap along the resilient sidewall thereof.

6. The fluid applicator in accordance with claim 5 wherein the resilient cap further includes a plurality of peripherally spaced-apart exterior ribs, each such rib being integral not only with the cap sidewall but also with an exterior surface portion of the resilient cap, to provide the resilient cap sidewall with radial and longitudinal support for opposing substantial resilient cap sidewall deformation when the ring is disposed into the cap cavity.

7. The fluid applicator in accordance with claim 5 wherein the insert ring defines a hole that surrounds the domed surface of the cap, the cross-sectional area of the ring hole being so dimensioned relative to the cross-sectional area of the domed surface as to allow a major portion of the domed surface to be disposed through the ring hold and brought into biasing engagement with the fluid-distributing substance for opening the valve means.

8. The fluid applicator in accordance with claim 1 wherein the domed surface of the cap further includes an exterior, integral protuberance, extending outwardly from the cap cavity and disposed toward the fluid-distributing substance.

9. In combination with a fluid container having an opening and being reversibly movable from an upstanding position whereby fluid is substantially contained by the container to an inverted position whereby fluid is able to flow through the fluid-container opening by a gravity, a fluid applicator comprising:

a cap having a sidewall defining a cavity, the cap being removably engageable with the fluid container at the opening thereof, the cap being so configured as to provide the fluid container with a substantially fluid-tight seal along the opening thereof, the cap having a resiliently-deformable domed surface surrounded by the sidewall, a portion of the domed surface extending outwardly from the cap cavity, the domed surface defining at least two spaced-apart apertures; and an insert removably disposable into the cap cavity and engageable with the cap sidewall, the insert comprising a fluid-distributing substance;

at least one of the two spaced-apart apertures providing the domed surface with a valve means (1) which opens in response to deformation of the domed surface to allow fluid to flow by gravity through the one aperture thereby effecting fluid communication from the container to the fluid-distributing substance when the container is disposed in the inverted position and a portion of the domed surface in the vicinity of such aperture is subjected to a predetermined dome-deforming force and (2) which closes automatically in a substantially fluid-tight manner upon removal from the domed surface of the predetermined force, the domed surface being so configured as to enable fluid to flow by gravity generally away from each of the apertures when the container is disposed in the upstanding position;

at least a portion of the insert being movable relative to the domed surface for removably applying the predetermined force to the domed surface, for opening and closing the valve means.

10. The combination in accordance with claim 9 wherein the sidewall includes a radially-inwardly disposed, integral flange for removably retaining the insert in the cap cavity.

11. In combination with a hand-held fluid container having an opening and being manually reversibly movable from an upstanding position whereby fluid is substantially contained by the container to an inverted position whereby fluid is able to flow through the fluid-container opening by gravity, a fluid applicator comprising:

a cap having a sidewall defining a cavity, the cap being removably engageable with the fluid container at the opening thereof, the cap being so configured as to provide the fluid container with a substantially fluid-tight seal along the opening thereof, the cap having a resiliently-deformable domed surface surrounded by the sidewall, a portion of the domed surface extending outwardly from the cap cavity, the domed surface defining at least two spaced-apart apertures; and an insert removably disposable into the cap cavity and engageable with the cap sidewall, the insert comprising a ring and a fluid-distributing substance affixed to the ring;

at least one of the two spaced-apart apertures providing the domed surface with a valve means (1) which opens in response to deformation of the domed surface to allow fluid to flow by gravity through the one aperture thereby effecting fluid communication from the container to the fluid-distributing substance when the container is disposed in the inverted position and a portion of the domed surface in the vicinity of such aperture is subjected to a predetermined dome-deforming force and (2) which closes automatically in a substantially fluid-tight manner upon removal from the domed surface of the predetermined force, the domed surface being so configured as to enable fluid to flow by gravity generally away from each of the apertures when the container is disposed in the upstanding position;

at least a portion of the insert being movable relative to the domed surface for removably applying the predetermined force to the domed surface, for opening and closing the valve means.

12. The combination in accordance with claim 11 wherein the cap further includes an integral annular collar having a cross-sectional area dimensioned relative to the cross-sectional area of the fluid container opening, and configured, so as to provide the container with the substantially fluid-tight seal along the opening thereof.

13. The combination in accordance with claim 11 wherein the fluid-distributing substance is reticulated polyurethane.

14. The combination in accordance with claim 11 wherein the domed surface defines three spaced-apart apertures, each such aperture being characterized as a radially disposed slit, any one slit being spaced substantially equally from its two nearest slit neighbors.

15. The combination in accordance with claim 11 wherein the cap is of a substantially resilient material, wherein the ring is of a substantially rigid material, wherein the resilient cap sidewall defines an inner circumferential slot of radial and longitudinal dimension sufficient to receive the ring and to allow the ring to be moved relative to the cap sidewall for opening and closing the valve means, and wherein the ring cross-sectional area is so dimensioned relative to the cross-sectional area of the resilient cap sidewall as to enable the ring not only to be removably disposable into the cap cavity but also engageable with the resilient cap along the sidewall thereof.

16. The combination in accordance with claim 15 wherein the resilient cap further includes a plurality of peripherally spaced-apart exterior ribs, each such rib being integral not only with the cap sidewall but also with an exterior surface portion of the resilient cap, to provide the resilient cap sidewall with radial and longitudinal support for opposing substantial sidewall deformation when the ring is disposed into the cap cavity.

17. The combination in accordance with claim 15 wherein the insert ring defines a hole that surrounds the domed surface of the cap, the cross-sectional area of the ring hole being so dimensioned relative to the cross-sectional area of the domed surface as to allow a major portion of the domed surface to be disposed throught the ring hole and brought into biasing engagement with the fluid-distributing substance for opening the valve means.

18. The combination in accordance with claim 11 wherein the domed surface of the cap further includes an exterior, integral protuberance, extending outwardly from the cap cavity and disposed toward the fluid-distributing substance.

* * * * *

UNITED STATES PATENT AND TRADEMARK OFFICE

CERTIFICATE OF CORRECTION

PATENT NO. : 4,762,433

DATED : August 9, 1988

INVENTOR(S) : Larry W. Bergeson, Vincent J. Lasorso, Jr., Russell H. Petersen, Ronald G. Ruffalo It is certified that error appears in the above-identified patent and that said Letters Patent is hereby corrected as shown below:

In Column 8, Line 16, the word "hold" should be --hole--.

In Column 8, Line 29, the word "a" should be deleted.

Signed and Sealed this

Fourteenth Day of February, 1989

*Attest:*

*Attesting Officer*

DONALD J. QUIGG

*Commissioner of Patents and Trademarks*